United States Patent [19]

Gish

[11] 4,186,681

[45] Feb. 5, 1980

[54] PROTECTION AGAINST INFLUENCE MINES

[75] Inventor: Oliver H. Gish, Fort Pierce, Fla.

[73] Assignee: The United States of America as represented by the Secretary of the Navy, Washington, D.C.

[21] Appl. No.: 330,198

[22] Filed: Dec. 12, 1963

[51] Int. Cl.[2] ..... B63G 9/00

[52] U.S. Cl. ..... 114/240 R; 102/18 MS

[58] Field of Search ..... 114/0.5, 240; 250/83

[56] References Cited

U.S. PATENT DOCUMENTS

| | | | |
|---|---|---|---|
| Re. 24,544 | 9/1958 | Morganstern | 114/73 |
| 3,110,282 | 11/1963 | Foerster | 114/240 R |

*Primary Examiner*—David H. Brown

*Attorney, Agent, or Firm*—Louis A. Miller; Rolla N. Carter

EXEMPLARY CLAIM

1. Apparatus for decreasing the intensity of cosmic rays at a selected distance beneath a relatively empty displacement volume in an otherwise uniformly loaded ship floating on a body of water comprising in combination, a ship having a relatively empty displacement volume, and means for establishing in vertical alinement with said volume a charged particle deflecting field having a strength and configuration effective to divert from a region at said selected distance directly beneath said volume a major fraction of the charged particles which would be prevented from reaching said region by absorption in water displaced by said volume.

5 Claims, 4 Drawing Figures

PROTECTION AGAINST INFLUENCE MINES

The invention described herein may be manufactured and used by or for the Government of the United States of America for governmental purposes without the payment of any royalties thereon or therefor.

The present invention relates to defensive measures against influence mines and has for an object the provision of measures for reducing, distorting or nullifying the cosmic ray signature of large ships for the purpose of protecting the ship against naval mines designed to be actuated by a change in cosmic ray intensity caused by the passage thereover of an unevenly loaded ship.

Cosmic ray mines are designed to respond only when a change in cosmic ray intensity, integrated over a selected time interval, satisfies certain prescribed conditions which supposedly will be brought about only by the passage of the type of ship selected as a target. The variation in intensity of the radiation received by a fixed point on the seabed as a ship approaches, passes over and recedes from said fixed point is referred to as the ship's cosmic ray signature. Since it is a principle in the design of any influence mine that it must not be fired in response to naturally occurring variations of the pertinent influence, such as those caused by waves, seiches, tides, etc., it is evident that if a ship's signature can be disguised so as to simulate any such naturally occurring variation the mine will be confused and thereby frustrated. For these reasons practical targets are limited to ships of the order of 10,000 tons or larger since relatively small ships cannot be distinguished from background.

There is no generally accepted theory of the origin of cosmic rays other than that they originate outside the atmoshpere. Primary cosmic rays are predominately protons and alpha particles with the former estimated to be about four times as abundant as the latter. These primary rays, in passing through the atmosphere, collide with the nuclei of gasses to give rise to secondary rays which consist of photons and several types of charged particles prominent among which are mesons. The pi-mesons produced largely by the primary particles have a half-life of approximately $2.5\times10^{-8}$ seconds and decay into mu-mesons which are positive or negative depending upon the charge carried by the parent pi-meson. It is these mu-mesons which make up the predominant component of cosmic rays at sea level. These mu-mesons are energetic and will penetrate to a considerable depth of water to influence a cosmic ray mine at say 50 feet. At sea level, the energy of the mesons is said to range from an approximate minimum of $10^8$ to at least $10^{15}$ ev. The energy of about half of these mesons is less than $2\times10^9$ ev. Since a mu-meson loses approximately $2\times10^8$ ev of its energy when it traverses 1 meter of water ($1.8\times10^8$ ev for 1 yard), those which have $2\times10^9$ ev of energy can penetrate just 10 meters (approximately 11 yards); those with $3\times10^9$ ev of energy, 15 meters (approximately 17 yards). A cosmic ray mine which is placed at a 50-foot depth (about 15 meters) will see little increase, during the passage of a ship, in the number of mesons whose energy at sea level exceeds $5\times10^9$ ev; moreover, such a mine will seldom see mesons of energy much less than $10^9$ ev. Thus, mu-mesons with energies in the approximate range of $10^9$ to $5\times10^9$ ev are of prime concern.

The actual cosmic ray signature of a ship is doubtless very complex and cannot be calculated readily even for simple models because of the dependence upon the character and the distribution of mass of both the structure of the ship and its loading. If the mass or matter of a ship were uniformly distributed over its length, no appreciable cosmic ray signature would result. However, a real ship is not uniformly loaded, but has relatively empty displacing volumes such as the engine room or an empty tank or empty load compartment. For a 10,000 ton tanker, for instance, the relatively empty displacing volume of the engine space has a length about equal to the beam width of the ship which would be roughly 50 feet and the draft about 22 feet. Such an empty displacing volume permits for the selected time interval an increase in intensity of cosmic radiation which may amount to as much as 20% of the normal value. It is this uneven loading which produces the cosmic ray signature of the ship for which a mine mechanism must be adapted to respond while discriminating between a ship and a wave or other natural variations in the radiation. It is evident that for mine defense purposes, considerable safety could be achieved by appropriate disposition of cargo and ballast so as to break the signature into shorter elements which resemble naturally occurring variations. Such protective loading would serve in the case of cosmic ray mines much the same as degaussing does in the case of magnetic mines. With respect to existing ships, in many cases it is not feasible to distribute the load uniformly enough to provide protection and it is an object of the present invention to provide for the defense of such unevenly loaded ships against cosmic ray mines by establishing a charged particle deflecting field in vertical alinement with any large relatively empty displacing volume in such ships.

Mine mechansim designers claim that the cosmic ray mine can be made substantially immune to radiations from radioactive material and that the mine will thus be extremely difficult to sweep by strong radioactive sources whose energetic decay products are primarily gamma rays, i.e., photons. To the extent that the claims of the mine designers are valid, it is probable that a sweep array utilizing long wire streamers containing radioactive material such as cobalt 60 would have to be so strongly radioactive as to render it hazardous to store and handle.

The present invention utilizes the phenomenon that electrically charged particles such as the positively and negatively charged mu-mesons are subjected to forces which alter their motion when they are moving in either an electric or a magnetic field. It seems evident that any device for utilizing this phenomenon can be effective over only a rather restricted area and since this area would be the one within which the explosion of a mine would doubtlessly destroy the device, the use of such a device for sweeping cosmic ray mines is not very attractive. The present invention is directed to the employment of a charged particle deflecting field as a means for providing protection to individual ships.

A long charged wire supported in a vertical position over an empty displacing volume in a ship will, if positively charged, attract particles of negative sign and repel those of positive sign. Thus rays coming from near the zenith tend to converge toward the wire if they carry a negative charge and to diverge from the wire if they carry a positive charge. All positive rays coming originally from the zenith will be removed from a region concentric with the wire. The cross-sectional area of this region at the bottom of the wire is circular with a radius which depends upon the energy of the particles, the length of wire and its charging potential, e.g., this radius may be one meter when the energy of the particles is about $10^9$ ev and the wire is about ½ kilometer long and charged to the maximum practical potential of say 10,000 volts/centimeter at the surface of the wire. This value is about one-third of the dielectric strength of air at normal temperature and pressure. The relative change in the cosmic ray flux in this area at the bottom of the wire is not the same as the ratio (about 0.54 ) of the number of positive particles usually present in cosmic rays to the total number of particles present because positive rays from other than the vertical direction tend to diverge but are not diverted from the entire area. Negative rays from the vertical direction which reach the wire supposedly lose most of their energy so that the negative rays from other than the vertical direction which tend to converge toward the area is not an important factor and there is a net decrease of flux in this area. It is this net decrease of flux which erases or blurs the cosmic ray signature of a ship to an extent adequate for protection against cosmic ray mines. In connection with the foregoing, it is noted that rays coming from zenith angles 0° to 30° contribute about 95% to the vertical flux density at the earth's surface.

In accordance with another embodiment of the invention, the charged particle deflecting field is provided by an electrical condenser with its plates set in a vertical plane. If the condenser consists of three parallel plates with the outer plates grounded and the central plate positively charged, there will be an area at the base and or both sides of the central plate from which all positive rays coming from the zenith are diverted. The length of this area is about the same as the horizontal extent of the condenser. All vertical negative rays which enter the top of the condenser and which have the same energy as the positive rays are diverted to the central plate which presumably reduces their energy to such an extent that most of them may be disregarded. The change in flux density at the bottom of the condenser depends approximately upon the solid angle of the opening at the top of the condenser as viewed from the bottom. If the solid angle from which the affected rays enter the condenser is about 0.04 steradian, these rays would contribute about 10% to the total flux density at the earth's surface (the percentage in water increases with depth) and thus such a condenser can effect a change in flux density at a mine of about 10%. A condenser having three parallel plates with an angular opening of 0.04 steradian and with sufficient height to affect an area one meter wide at its base would be an unwieldly structure but the basic idea may be utilized in the form of a multi-element cylindrical condenser of practical dimensions.

In another embodiment of the invention, the charged particle deflecting field comprises the magnetic field of a solenoid in the form of a torus lying with its broad side in a horizontal plane. By making this solenoid to have 10,000 ampereturns the radius of curvature of the path of cosmic rays with $10^9$ ev energy is about 2.6 meters and by making the radius of a turn of the solenoid the same value a vertical ray entering the solenoid at the top of a circular section will be deflected through 90° so as to leave the solenoid in a horizontal direction. All other rays within the range of zenith angles, 0° to 30° emerge in a direction differing from the vertical. It is thus apparent that practically all cosmic rays incident on its upper surface will be diverted from the region below such a torodial solenoid. The reduction of flux density will be much larger than that obtained by a cylindrical condenser occupying the same volume for protecting the engine room of a 10,000 ton tanker. Exemplary dimensions are a torus height (diameter of a turn) of 5 meters and the outer diameter of the torodial coil about 12 meters. In certain ship structures a combination of the electrical and magnetic devices provides advantages.

The invention will be fully understood from the following detailed description of preferred embodiments thereof when read in connection with the accompanying drawing in which.

Figure 1:
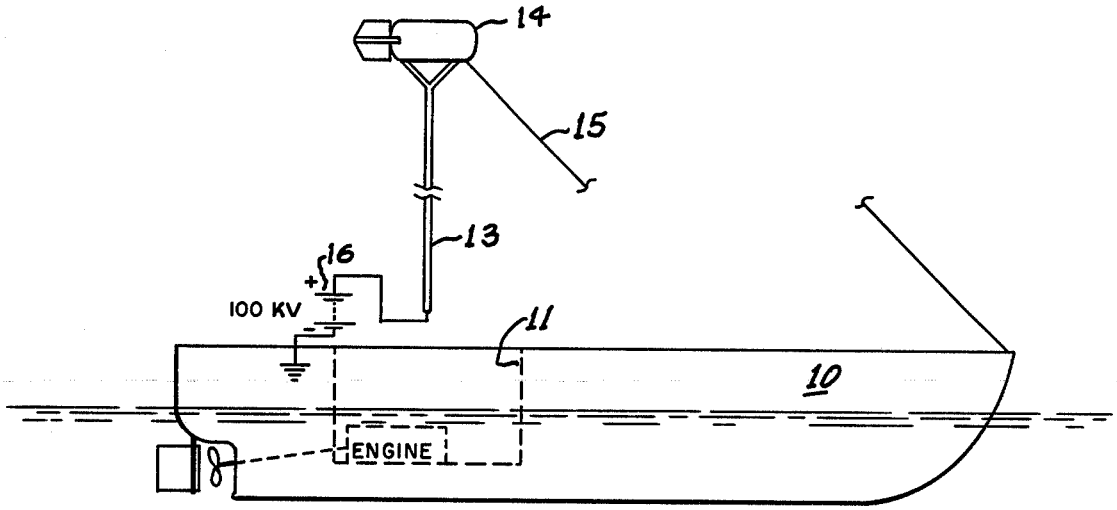
FIG. 1 is a view of a ship protected in accordance with one embodiment of the invention and a chart showing the cosmic ray signature of the ship.

In FIG. 1 there is shown a ship 10 assumed to be uniformly loaded along its length except for a relatively empty displacing volume, indicated by a broken line 11, utilized for the engine room and associated non-cargo space. The cosmic ray signature of the ship 10 is shown in the form of a graph 12 indicating the relative changes in the intensity of cosmic ray flux brought about by the unevenly loaded ship 10, the "+" and "−" symbols indicating increases and decreases, respectively, in the cosmic ray flux. The signature graph 12 is simplified to represent the case of the ship 10 being evenly loaded fore and aft with a bulk specific gravity of approximately unity which would prevail for example in a fully loaded tanker. The engine room space 11 represents a relatively empty displacing volume having a bulk specific gravity considerably less than unity and thus less absorptive of cosmic ray flux and an increase in intensity will occur under this portion of the ship as indicated by the positive value of the signature graph 12. As used herein, the bulk specific gravity is the ratio of the weight of the load to the weight of water which would occupy the same volume as the load.

In accordance with the invention, the normal increase in cosmic ray flux due to the lower absorption by the empty volume 11 is to a considerable extent nullified, compensated or made discontinuous by establishing a charged particle deflecting field in vertical alinement with the relatively empty displacing volume 11 to the end that charged particles coming from the general direction of the zenith, depending upon their sign, are partially absorbed or deflected so as to reduce the concentration of the rays which would otherwise contribute to the positive portion of the signature graph 12.

As shown in FIG. 1 the charged particle deflecting field is provided by an elongated electric conductor 13 suspended vertically over the volume 11, as by a blimp 14 which is suitably stabilized in position by one or more guy wires 15. The conductor 13 being charged by a suitable source of potential 16. The conductor 13 may be any suitable material but it is preferred to employ a plastic wire in the form of a thin-wall tube which may be inflated with air and having a smooth outer conductive surface with just enough electrical conductivity to maintain the desired distribution of the charge thereon. This embodiment of the invention contemplates the use of two or more vertical conductors spaced athwart the vessel to be protected to widen the discontinuity in the transverse direction of the ship's signature.

Inasmuch as the protection of each ship is an individual problem, only general guidelines can be prescribed for practicing the invention. As was suggested earlier, the restrictions on the design of cosmic ray mines so as not to respond to natural variations makes it quite likely that the smallest target vessel would be in the 10,000 ton class. For such a class vessel that might be considered typical, the length of the charged conductor 13 would be of the order of ½ kilometer, its radius one centimeter, and charged so as to provide a field strength of 10,000 volts per centimeter at the surface of the conductor 13. For the maximum length of one kilometer visualized for the conductor 13, the required voltage is not greater than 100,000 volts and, assuming no glow (or corona) discharge exists the ionic conduction current to the atmosphere would be about one microampere. It is understood, of course, that the choice of length of the conductor 13 and the number of conductors utilized depend primarily upon the size of the empty displacement volume to be coped with or protected.

Figure 2:
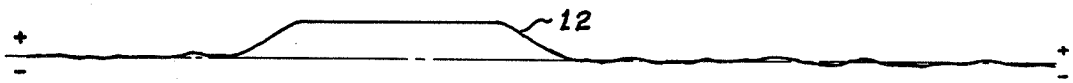
FIG. 2 is a diagrammatic fragmentary view of an embodiment of the intention utilizing an electrical condenser.
Figure 2:
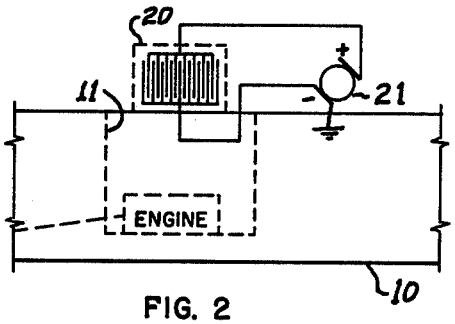
Figure 3:
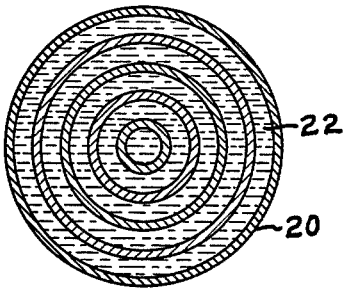
FIG. 3 is a diagrammatic cross-sectional view of the condenser of FIG. 2.

FIG. 2 illustrates an embodiment of the invention utilizing an electrical condenser 20 for establishing the charged particle deflecting field in accordance with the invention. As shown in FIG. 3, this condenser 20 is comprised of a plurality of concentric cylinders with axes vertical, alternate cylinders grounded and the other cylinders maintained at a positive potential from a suitable source 21 of dc voltage. If the concentric cylinders of the condenser 20 are 16 feet high, spaced 1.25 centimeters apart, and charged to 50,000 volts, the condenser 20 will be effective in reducing to a satisfactory level the flux density in a region below the condenser 20, the horizontal cross-section of this region being substantially equal to the cross-section of the condenser 20. As indicated in FIG. 3, the condenser 20 may be filled with oil 22 for storage purposes.

Figure 4:
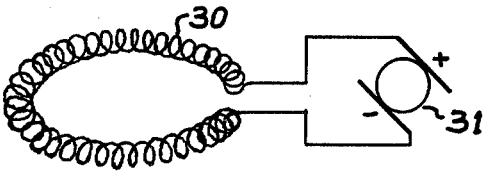
FIG. 4 is a view in diagrammatic form of a torodial solenoid suitable for protecting the ship of FIG. 1.

FIG. 4 illustrates the embodiment of the invention utilizing a torodial solenoid 30 energized by a direct current source 31, the magnetic field of which establishes the charged particle deflecting field according to the invention when positioned in alinement with the empty displacing volume 11 and with the plane of its torus horizontal. If the solenoid 30 is provided with a ferromagnetic core, its radius may be made less than the exemplary dimensions mentioned above. However, in most practical cases, the added weight of such a core would more than offset the advantages derived from any reduction in the diameter of the turns in the solenoid 30. As was indicated above, the condenser 20 may be placed within the torus 30 to make possible a reduction in the size of each and still provide the desired charged particle diverting field.

Obviously many modifications and variations of the present invention are possible in the light of the above teachings. It is therefore to be understood that within the scope of the appended claims the invention may be practiced otherwise than as specifically described.

What is claimed is:

1. Apparatus for decreasing the intensity of cosmic rays at a selected distance beneath a relatively empty displacement volume in an otherwise uniformly loaded ship floating on a body of water comprising in combination, a ship having a relatively empty displacement volume, and means for establishing in vertical alinement with said volume a charged particle deflecting field having a strength and configuration effective to divert from a region at said selected distance directly beneath said volume a major fraction of the charged particles which would be prevented from reaching said region by absorption in water displaced by said volume.

2. Apparatus in accordance with claim 1 wherein the means for establishing the charged particle deflecting field comprises at least one elongated charged conductor suspended vertically in alinement with said relatively empty displacement volume.

3. Apparatus in accordance with claim 1 wherein the means for establishing the charged particle deflecting field comprises a toroidal solenoid mounted in vertical alinement with said relatively empty displacement volume with the axis of the solenoid defining a horizontal plane, and a source of direct current connected to said solenoid.

4. Apparatus in accordance with claim 1 wherein the means for establishing the charged particle deflecting field comprises an electrical condenser mounted in vertical alinement with said relatively empty displacement volume with the plates of said condenser vertically oriented, and means for charging said condenser.

5. Apparatus in accordance with claim 4 wherein the plates of said condenser comprises a plurality of concentric cylinders having vertical axes in common.

* * * * *